US007789523B2

(12) United States Patent
Arnold, III

(10) Patent No.: US 7,789,523 B2
(45) Date of Patent: Sep. 7, 2010

(54) RECEPTACLE POSITIONED RECHARGEABLE FLASHLIGHT

(76) Inventor: Vaughn R. Arnold, III, 12167 Orange Blvd., West Palm Beach, FL (US) 33412-1417

( * ) Notice: Subject to any disclaimer, the term of this patent is extended or adjusted under 35 U.S.C. 154(b) by 317 days.

(21) Appl. No.: 12/104,933

(22) Filed: Apr. 17, 2008

(65) Prior Publication Data

US 2009/0002977 A1 Jan. 1, 2009

Related U.S. Application Data

(60) Provisional application No. 60/946,580, filed on Jun. 27, 2007.

(51) Int. Cl.
*F21L 4/00* (2006.01)

(52) U.S. Cl. ..... 362/183; 362/488; 439/668

(58) Field of Classification Search ..... 362/183, 362/190, 196, 202, 205, 488, 489, 640, 652, 362/655; 439/668, 639, 929, 533; 320/107, 320/114, 115

See application file for complete search history.

(56) References Cited

U.S. PATENT DOCUMENTS

| | | | |
|---|---|---|---|
| 3,309,598 | A | 3/1967 | Montgomery et al. |
| 4,224,658 | A | 9/1980 | Siiberg |
| 4,325,107 | A | 4/1982 | MacLeod |
| 4,514,790 | A | 4/1985 | Will |
| 4,713,735 | A | 12/1987 | Hiltman |
| 4,819,139 | A | 4/1989 | Thomas |
| 4,825,345 | A | 4/1989 | Stevens |
| 4,838,236 | A | 6/1989 | Kadlacek |
| 5,007,863 | A | 4/1991 | Xuan |
| 5,309,336 | A | 5/1994 | Hartt et al. |
| 5,832,645 | A | 11/1998 | Wells |
| 5,908,233 | A | 6/1999 | Heskett et al. |
| 6,478,628 | B1 | 11/2002 | Ming |
| 6,612,875 | B1 | 9/2003 | Liao |
| 6,842,356 | B2 | 1/2005 | Hsu |
| 6,986,595 | B2 | 1/2006 | Wunsch |
| 7,338,328 | B2 | 3/2008 | Krieger et al. |
| 7,427,216 | B1 | 9/2008 | Wu et al. |
| 7,438,602 | B2 | 10/2008 | Montgomery et al. |
| 2003/0026092 | A1 | 2/2003 | Reese et al. |
| 2004/0061943 | A1 | 4/2004 | Bosch et al. |
| 2004/0204177 | A1 | 10/2004 | Pon |
| 2006/0082991 | A1 | 4/2006 | Hrabal |
| 2006/0146527 | A1 | 7/2006 | VanderSchuit |
| 2006/0176687 | A1 | 8/2006 | Cope |
| 2006/0274541 | A1 | 12/2006 | Sheen |

*Primary Examiner*—Gunyoung T Lee
(74) *Attorney, Agent, or Firm*—McHale & Slavin, P.A.

(57) ABSTRACT

A plug-in rechargeable flashlight that may be inserted into a conventional cigarette lighter or battery power source receptacle found in an automobile, airplane, boat or other vehicle. The flashlight has light emitting diodes as the primary light source located on the end of the flashlight which is insertable into the power receptacle concealing the light source. When the flashlight is plugged into the receptacle the primary light source is extinguished. The flashlight is further provided with an electrical output connection at the opposite end of the primary light source allowing the flashlight to serve as a replacement socket for the power receptacle consumed by the flashlight. The replacement socket provides an electrical connection for receipt of additional powered accessories, or limited in use to pre-selected items such as a USB port, AC port, backlighting, and so forth. The ports may be further isolated such as having a removable USB port that allows use of the powered receptacle in the normal manner or modified for use with USB ports by insertion of the removable USB port.

43 Claims, 10 Drawing Sheets

RECEPTACLE POSITIONED RECHARGEABLE FLASHLIGHT

PRIORITY CLAIM

The application claims a priority date on provisional Patent Application No. 60/946,580 filed Jun. 27, 2007, the contents of which are incorporated herein by reference.

FIELD OF THE INVENTION

The present invention relates to a rechargeable flashlight and in particular to rechargeable flashlight that is stored within a DC powered receptacle and is available for use in powering additional electrical devices.

BACKGROUND OF THE INVENTION

Rechargeable flashlights have been used for many years. Typically, flashlights use batteries to power an incandescent bulb. Reflectors around or behind the bulb have been provided to help direct light from the bulb. The flashlight provides a means for illumination in times of an emergency, or for finding items in the dark. To prevent misplacement, flashlights are typically stored in a vehicle glove box. However, with the flashlight out of sight it is not uncommon for the battery source to become stale due to high heat, extreme cold, or age, any of which can render the flashlight useless in times of need. Also, in an emergency the availability of the flashlight being stored in a glove compartment must be recalled otherwise the vehicle must be searched. If the vehicle is an automobile, airplane or boat, attempting to locate a flashlight while operating the vehicle can be quite dangerous.

The recent development of light emitting diodes (LED's) has provided a unique lighting mechanism that can compliment or even replace the incandescent bulb. Use of an LED as a light source in a flashlight has several advantages. Initially, LED's use less power than incandescent bulbs so that the battery life in an LED flashlight can be greatly extended and/or smaller batteries can be used. LED's also have a very long operating life, far longer than most incandescent bulbs. Consequently, the disadvantages of bulb burnout or failure, and the need to replace bulbs relatively frequently, are largely avoided. However, battery life of a non-charged battery remains affected by non-use, the actual life of the battery becoming dependant upon surrounding environmental conditions.

Rechargeable batteries for use in flashlights is known in art and typically consist of a housing that contains a light source, battery, and battery charging circuit that is electrically connected to a rechargeable battery. Typically, an external connector is provided on the flashlight housing for coupling to a suitable power source, or an electrical charging circuit. While the use of rechargeable batteries in portable flashlight devices has been known for some time, recharging generally is achieved by an external charging circuit, such as via standard wall sockets, thereby limiting the size of the flashlight. If an AC power supply is needed, the flashlight cannot be recharged in a DC powered vehicle unless yet another converter is provided. For this reason, it is beneficial to have a DC powered charger when a rechargeable battery is placed into a vehicle.

While a flashlight may be plugged into a DC source a conflict exist because of the advent of cell phones, i-pods, portable e-mail devices, portable CD players, and the like that all rely upon the DC source. The result is the flashlight charging becomes secondary and the flashlight is stored, such as in the glove compartment, in order to allow access to the more commonly used devices such as cell phones, i-pods, portable e-mail devices, portable CD players, and the like. Further, conventional flashlights take up valuable floor space and may become a flying object should the vehicle be involved in an accident Rechargeable flashlights for use in an automotive environment have not been the most convenient to use as they are generally oversized and require various connectors, long lengths of wires, and are generally difficult to use. A flashlight, to be fully functionally, must be capable of complete mobility and not encumbered by size, the attachment of cords, or other ancillary devices. The use of a flashlight on a boat can be necessity should a problem occur after dark. However, the infrequent use of most boats makes for a charging system that may not operate for a month at a time leaving the flashlight with a weak or inoperative light. The use of a flashlight in an airplane is required for night flying wherein a pilot may need directed light for preflight inspection, chart viewing, instrument viewing, and so forth all at a light level or color that will not disturb the pilot's night vision. Allowing any item to be loose in a cockpit is very dangerous should the plane hit turbulence, however, having a flashlight stored in the baggage area or any area remote to the pilot would render it useless in an emergency.

It is also essential that an emergency light is fully charged, as well as being readily accessible. If the batteries are not kept at the optimum charge, the longevity of the batteries is shortened, the operating time is shortened, and the intensity of the light is diminished.

The configuration of modern day vehicle, whether the vehicle is an automobile, truck, airplane, boat and so forth includes the use of a cigarette lighter. While most vehicle owners no longer tolerate smoking, the cigarette lighter receptacle has carried on a power source receptacle. The cigarette lighter has been removed and the receptacle now receives power cord connections to various devices such as cell phones, MP3 players, GPS navigation systems, personal digital assistants (PDA s), laptop computers, and so forth.

Thus, what is lacking in the art is a portable flashlight that is readily available for use, maintained at the highest battery charge possible, is securely mounted without tools and provides a pass through connector for other device connections.

DESCRIPTION OF THE PRIOR ART

The prior art discloses various flashlights and connector for use in a conventional cigarette lighter or power supply socket.

U.S. Pat. No. 4,325,107 discloses a rechargeable flashlight having a casing of dielectric material including adapter means for recharging the batteries from a power source such as a battery in a vehicle. This device employs an adapter means including a phono plug terminal mating with a phono jack in the flashlight's casing wall and a terminal plug for insertion into a conventional cigarette lighter receptacle on a vehicle's dashboard.

U.S. Pat. No. 4,224,658 discloses a rechargeable flashlight that fits into and draws recharging power from an automobile cigarette lighter socket. When the flashlight is withdrawn from the socket it is illuminated, alternatively the flashlight may be manually illuminated or extinguished outside the charging socket.

U.S. Patent No. 2006/0274541 A1 describes a car flashlight structure that can be plugged into a car charger. The car flashlight can be plugged into the car charger to replenish electric power, and is taken out directly from the charger to use, whereupon a cap is pushed forward to actuate a contact switch and provide an electric current to the LED light of the illumination assembly, thereby furnishing the user with auxiliary illumination. The disadvantages associated with U.S. Pat. Nos. 4,325,107, 4,224,658 and 2006/0274541 A1 is that the flashlight, which requires a cigarette lighter socket for recharging means, occupies the only port in the vicinity of the driver thus not allowing other devices which are more commonly used to be charged simultaneously.

U.S. Pat. No. 5,309,336 discloses a rechargeable flashlight for automotive use having a universal connector for drawing power from any type of cigarette lighter receptacle. The rechargeable flashlight and universal connector can be integral in a single body, the body housing a rechargeable battery, lens/lamp assembly, and spare bulbs. Alternatively, the universal connector can be separated and need not be used in combination with the flashlight; the universal connector may provide a source of current for a variety of other electrical appliances. However, not all electronic devices are compatible with the positive and negative leads extending from the universal connector. In addition to switching between devices for charging purposes creates a hazard for a driver whom should be concentrated on the road.

U.S. Patent No. 2006/0082991 A1 discloses a flashlight having internal battery power. The flashlight having multiple adapters that allows the batteries of the flashlight to provide power to other portable electronic instruments such as cell phones, CD players, cameras, etc; in addition to an adapter capable of recharging the internal battery power source of the flashlight in a cigarette lighter. The setback is low-life span for the internal batteries of the flashlight since the auxiliary electronic devices are drawing current directly from the internal batteries of the flashlight. Furthermore, the charging means for the flashlight is not within the body of the flashlight, thus making the apparatus cumbersome for a user with limited space in a vehicle.

U.S. Pat. No. 6,478,628 B1 discloses an adapter for a vehicle cigarette lighter socket. The adapter has a pair of socket members on one end and an oppositely arranged plug member on the other end. The plug member has an electrical contact at one end, which is electrically connected to the adapter. Two appliances can be powered from the first and second socket members. Using the adapter in conjunction with a rechargeable flashlight only requires the use of more equipment within a vehicle creating a bulky situation.

U.S. Pat. No. 4,325,107 "Rechargeable Flashlight" discloses a rechargeable flashlight having a casing of dielectric material and a means for recharging the batteries from a power source such as a battery in a vehicle. This device employs an adapter means including a phono plug terminal mating with a phono jack in the flashlight's casing wall and a terminal plug for insertion into a conventional cigarette lighter receptacle on a vehicle's dashboard.

U.S. Pat. No. 4,224,658, "Rechargeable Flashlight with Integral Variable Rate Battery Charger for Automotive Use" discloses a rechargeable flashlight that fits into and draws recharging power from an automobile cigarette lighter socket. When the flashlight is withdrawn from the socket it is illuminated, alternatively the flashlight may be manually illuminated or extinguished outside the charging socket.

U.S. Pat. No. 4,713,735, "Flashlight for Use in Vehicles" includes a flashlight having a housing and a mounting plug; the mounting plug pivotally mounted to the housing for movement between a stowed position located closely adjacent to the housing and a mounting position extending away from the housing and onto a cigarette lighter port.

U.S. Pat. No. 4,514,790, "Rechargeable Power Pack and a Pocket Lamp" discloses a rechargeable power pack for flashlights. The power pack is made up of a housing, an accumulator, a rectifier, and plug structure for use with a public electricity supply outlet. The power pack has an adapter plug structure, which may be used in conjunction with a cigarette lighter outlet of a vehicle so that the accumulator may be recharged with power.

U.S. Pat. No. 5,309,336, "Universal Connector and Automotive Cigarette Lighter Assemblies and Rechargeable Flashlight Incorporating Same" discloses a rechargeable flashlight for automotive use having a universal connector for drawing power from any type of cigarette lighter receptacle. The rechargeable flashlight and universal connector can be integral in a single body, the body housing a rechargeable battery, lens/lamp assembly, and spare bulbs. Alternatively, the universal connector can be separated and need not be used in combination with the flashlight; the universal connector may provide a source of current for a variety of other electrical appliances.

U.S. Patent No. 2006/0082991 A1, "Flashlight Adaptor for Providing Alternative Direct Current Power Supply to Other Electronic Instruments" discloses a flashlight having internal battery power. The flashlight having multiple adapters that allows the batteries of the flashlight to provide power to other portable electronic instruments such as cell phones, CD players, cameras, etc; in addition to an adapter capable of recharging the internal battery power source of the flashlight in a cigarette lighter.

U.S. Patent No. 2006/0274541 A1, "Car Flashlight Structure" describes a car flashlight structure that can be plugged into a car charger. The car flashlight can be plugged into the car charger to replenish electric power, and is taken out directly from the charger to use, whereupon a cap is pushed forward to actuate a contact switch and provide an electric current to the LED light of the illumination assembly, thereby furnishing the user with auxiliary illumination.

U.S. Pat. No. 6,478,628 B1 discloses an adapter for a vehicle cigarette lighter socket. The adapter has a pair of socket members on one end and an oppositely arranged plug member on the other end. The plug member has an electrical contact at one end, which is electrically connected to the adapter. Two appliances can be powered from the first and second socket members.

U.S. Pat. No. 5,908,233 discloses a flashlight equipped with rechargeable batteries inside its main housing. A removable tail cap contains an electronic circuit actuated and energized by means of a switch assembly for recharging the batteries. A mechanical isolation means is included for protecting the electronic circuit from being damaged by any physical movement of the batteries that may occur.

U.S. Pat. No. 4,713,735 discloses a flashlight having a mounting plug by which it may mount to a vehicle dashboard socket at various orientations and various rotary positions about the socket axis.

U.S. Pat. No. 4,819,139 discloses a rechargeable flashlight assembly intended particularly for use in automotive vehicles. The assembly comprises a receptacle adapted to be mounted on the dashboard, or other suitable location in the vehicle, and which houses an electrical charging unit; and a flashlight containing rechargeable batteries which is constructed to be inserted into the receptacle when not in use to establish contact with the charging units so that the batteries will be maintained in a charged state.

U.S. Pat. No. 4,825,345 discloses encompassed simplified equipment to provide a fully charged direct current portable light that may be readily mounted in the passenger compartment of a car.

U.S. Pat. No. 4,838,236 discloses a draw length and pull weight of a compound archery bow varied over a desired range by changing the positions of anchoring the ends of the bow string and power cable on the cam elements at the outer ends of the bow limbs. Each cam element is provided with a plurality of openings arranged in a desired pattern, and an anchor member is secured removably at any one of the openings by a screw extended through the opening and threaded into a tapped opening in the anchor member. A groove in the outer circumference of each anchor member removably receives a looped end of the bow string or power cable.

U.S. Pat. No. 5,007,863 discloses a module-type multi-function power outlet adapter for use of add-on electrical accessories in an automotive vehicle having a cigarette lighter socket. This device embodies a plurality of separate detachable modules which may be attached to a basic module inserted into the lighter socket and constructed to receive the additional modules to provide multiple electrical outputs. Such a module-type arrangement allows the adapter to fit the mounting space of cigarette light socket. A simple positioning pin structure ensures correct power leads connection and secures the combination between modules.

U.S. Pat. No. 5,832,645 discloses an automobile accessory comprising an illuminated picture frame which is insertable into a receptacle of a cigarette lighter of a motor vehicle for power and for mounting. The picture frame has a plug assembly which is compatible with the receptacle of the cigarette lighter with respect to interfit within the receptacle. The plug assembly also has electrodes located to connect to power from the receptacle. The plug assembly therefore both supports the picture frame and provides electrical power for lighting.

U.S. Pat. No. 5,908,233 discloses an auto rechargeable flashlight with a base having a weight coupled to a bottom. At least one recess is formed in a top face of the base with such recess having a pair of contacts situated on an inner side wall thereof. Further provided is a power cord having a first end coupled to the periphery of the base and a second end having a vehicle cigarette lighter adapter designed to be releasably plugged within a vehicle cigarette lighter socket for receiving power therefrom.

U.S. Pat. No. 6,986,595 discloses additional lighting in the cabin in motor vehicles, in places where a voltage supply and the mounting thereof in the cockpit can not satisfactorily be resolved. A plug-in rechargeable lamp which may be plugged into the 12V or 24V cigarette lighter socket with a light diode as light source, which gives a multi-application light source which may be used anywhere. The use of a light diode renders the lamp insensitive to shock effects and contributes to the lifespan thereof. The threshold voltage of the light diode is optimally matched to the final discharge voltage of the applied accumulator cells, such that a fill discharge of the accumulators is practically excluded.

U.S. Publication No. 2006/0176687 discloses a combination vehicle charger and flashlight providing illumination while a user connects a mobile device to the vehicle charger. A light source disposed on the mobile device plug of the vehicle charger connects to either an external or an internal power supply to provide a beam of light used to illuminate the mobile device.

U.S. Pat. No. 3,309,598 discloses a plastic embodiment having a dry cell receiver cavity therein and an adapter stem whereby it is receivable in a low voltage electric cigar lighter socket of an automobile. The body of the device is provided with a resilient electrical wire formed to make contact with one conductor of the socket as well as with a part of a closure member employed on the body thereof. A second conductor extends from the front of the stem to the interior of the cavity to make contact with a center terminal of a dry cell received therein.

While these patents disclose devices that may be suitable for their particular purpose to which they address, these devices would not be suitable for the purposes of the present invention as heretofore described.

SUMMARY OF THE INVENTION

As a consequence of these aforementioned problems, it is an objective of the present invention to provide a portable rechargeable flashlight that can be inserted into a conventional cigarette lighter receptacle so as keep battery life at fully capacity at all times; as well as allow continued use of auxiliary electronic devices. The plug-in rechargeable flashlight may be inserted into a conventional cigarette lighter/power point receptacle found in an automobile, airplane, boat or other vehicle. The flashlight can be charged from a range of 1.5 volts DC to 32 volts DC and has light emitting diodes as the primary light source. The primary light source is located on the end of the flashlight that plugs into the cigarette/power point receptacle making it easy to holster in the dark, as well as assure that accidental operation will not occur, such as when the device is used in an airplane cockpit. When the flashlight is plugged into the receptacle the primary light source is extinguished. The flashlight is also provided with an electrical output connection at the end of the flashlight opposite the primary light source. The electrical connection is powered when the flashlight is in the recharging position and off when the flashlight is removed from the cigarette lighter/power point receptacle. The electrical connection can power an additional light emitting diode, USB ports, AC port, or any other suitable electrical device while simultaneously recharging the flashlight battery.

It is a further objective of the instant invention to provide a rechargeable flashlight that is compact in size, reliable, easy to install, easy to use, attractive in appearance and provides power management for other electrical devices commonly found in a vehicle.

It is yet still another objective of the instant invention to provide a compact flashlight that can be plugged into a cigarette lighter receptacle to maintain the battery power at its peak efficiency.

It is another objective of the instant invention to provide a rechargeable flashlight that is automatically illuminated when it is removed from the power receptacle.

It is yet another objective of the instant invention to provide the rechargeable flashlight with an electrical power output connection to power additional auxiliary devices.

It is an additional objective of the instant invention to solve the damage problems that can occur within the cigarette lighter receptacle when plug in devices from different countries are utilized.

It is a still further objective of the invention to provide the rechargeable flashlight with an additional light source that is connected to the electrical output connection. The additional source of illumination can provide backlighting for a trademark, a logo, an individual's name or initials; and further acts as a beacon in the dark to easily guide the user to the rechargeable flashlight.

Still another objective of the invention is to disclose rechargeable flashlight light wherein the second end may include a USB removable insert.

Yet another objective is to provide the operators of movable vehicles, such as airplanes, with a readily accessible flashlight that is maintained at its peak charge and further allows the pass through of power for other items, such as GPS units, without the need of power socket splitters.

Still another objective of the invention is to teach the use of a non-conventional power socket having a deeper than conventional plug insert. The deeper plug insert allows for a deeper insertion of a flashlight of the instant invention, permitting a near flush mounting of the device. Such an application is particularly suited for OEM use wherein the vehicle is designed to accommodate a more aesthetically pleasing flashlight with minimal protrusion, or allowing for flashlights have a greater power reserve.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1A:
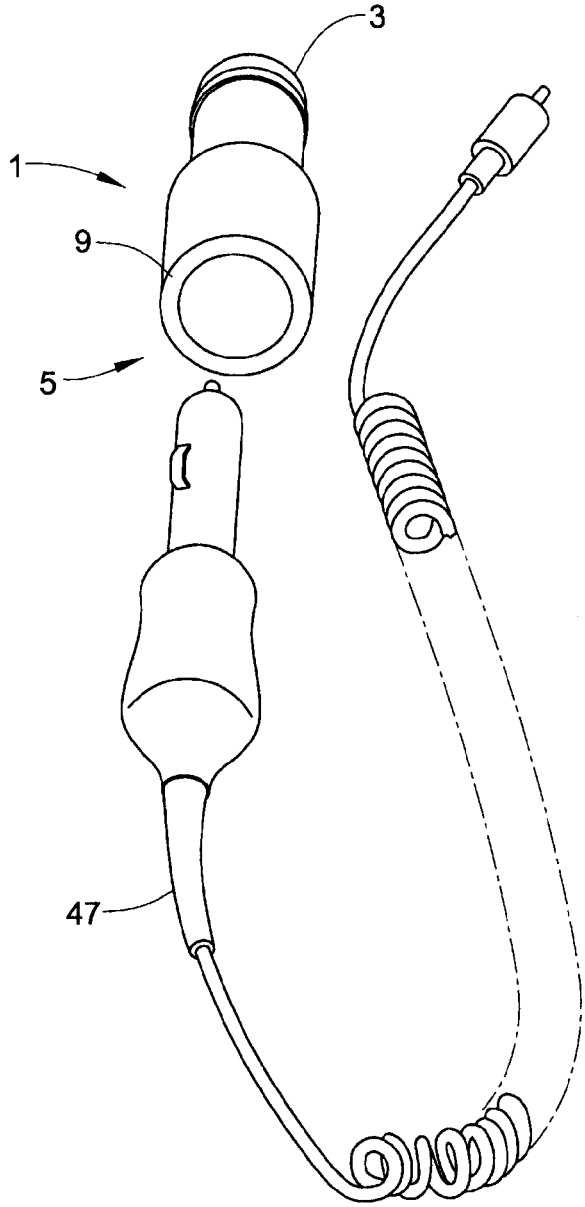
FIG. 1A is a pictorial representation of the preferred embodiment of the rechargeable flashlight.

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Referring now to FIGS. 1-5, wherein like elements are numbered consistently throughout. The present invention is directed to the use of a rechargeable flashlight within an automobile. However, use within an automobile is only for a suggested use of the rechargeable flashlight; as the rechargeable flashlight is readily used in trucks, boats, airplanes, or any other transportation device that employs a cigarette type power output. FIG. 1A illustrates one preferred embodiment of the rechargeable flashlight according to the present invention with an auxiliary electrical device connected to the electrical output connection, generally referenced herein as 100. FIG. 1B illustrates an alternative embodiment of the rechargeable flashlight according to the present invention with a supplemental light source connected to the electrical output connection. Rechargeable flashlight 100 comprises of a body 01, which is generally cylindrical in shape and closely resembles the size and shape of a typical vehicle cigarette lighter. The body 01 is preferably longer than the typical cigarette lighter receptacle 02 (not shown). The body 01 has a first end 03 and a second end 05. First end 03 contains a plug member 04 that is constructed to mechanically and electrically connect with the cigarette lighter receptacle 02. First end 03 is constructed to resemble a male port in a cigarette lighter assembly. Within first end 03 is housed a plurality of light emitting devices 13, from herein known as LED, to be used for illuminating purposes when the rechargeable flashlight 100 is unmounted from the charging position within the cigarette lighter receptacle. The plurality of LED's 13 is to automatically illuminate upon disengagement with the cigarette lighter socket 02 and turn off upon engagement with cigarette lighter socket 02 for charging purposes. In an alternative embodiment it is contemplated that LED's may be manually switched from an ON and OFF position by use of a dial, switch, or other means known in the art.

Figure 1B:
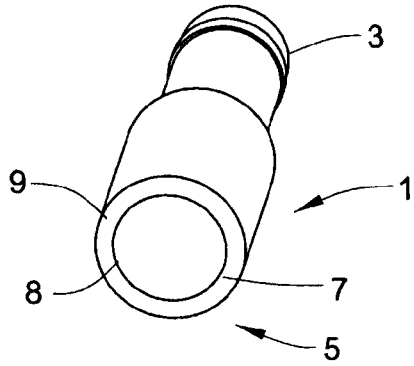
FIG. 1B is a pictorial representation of the preferred embodiment of the rechargeable flashlight with additional element.

In FIG. 1A, the second end 05 of the cylindrical body 01 is constructed with a housing member 09. The housing member 09 is similar in structure to a typical cigarette lighter receptacle 02. The housing member 09, in FIG. 1A, is ready to adapt to a male end 11 of an auxiliary electronic charging device 47. The housing member 09 is an electrical output connection for use with an auxiliary electrical device 47 such as cell phone charger. When the auxiliary electrical device 47 is engaged with the housing member, current is drawn from the vehicle's battery to provide current to both the rechargeable flashlight 100 and auxiliary electrical device 47. Auxiliary electrical devices 47 include, but are not limited to, cell phones, MP3 players, GPS navigation systems, personal digital assistants (PDA's), and lap top computer, or the like. In this manner, an auxiliary electrical device can be in use or on charge when the rechargeable flashlight 100 is connected the cigarette lighter receptacle 02. Alternatively, FIG. 1B shows rechargeable flashlight 100 with housing member 09 connected to a supplemental light source and lens, from herein known as backlight assembly 08. The backlight assembly 08 consists of a lens 10 and supplemental light source or second series of LED's 11, shown in FIG. 4 and described in detail below. The backlight assembly 08 is lit by the supplemental light source 11; and the lens 10, which can contain indicia such as trademarks, logos, corporate, product, or individual names, reflects the supplemental light source 11. In addition to providing an attractive effect, the backlight assembly 08 also serves as a beacon to enable the user to locate the rechargeable flashlight more easily.

Figure 2:
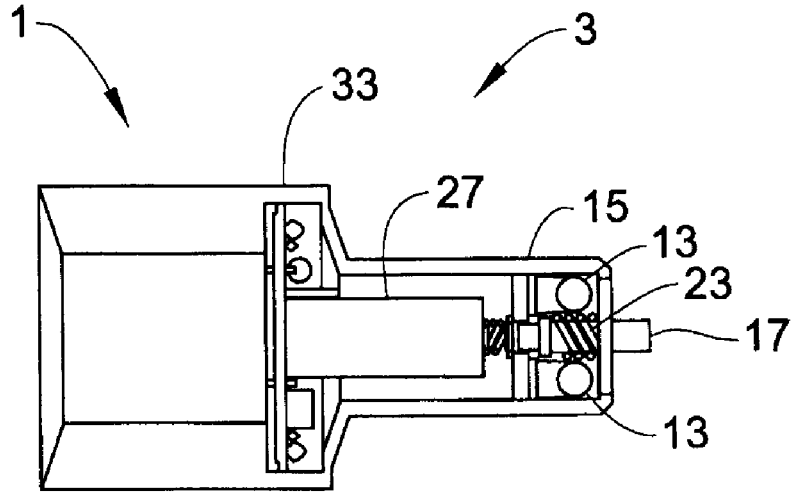
FIG. 2 is a cross sectional view of the preferred embodiment of the rechargeable flashlight.
Figure 3:
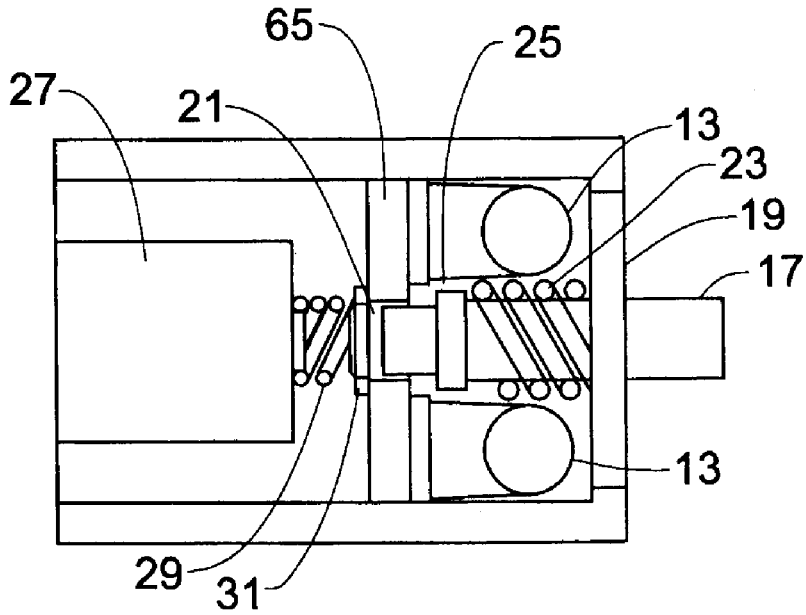
FIG. 3 is a cross sectional detailed view of FIG. 2.

In FIGS. 2 and 3, the first end 03 of rechargeable flashlight 100 contains at least one LED 13 that is mounted on a LED circuit board 15. The plug member 04 comprises of a center post 17, extending longitudinally across rechargeable flashlight 100, which is held within the first end 03 by a retainer member 19 and an aperture 21 in LED circuit board 15. A spring member 23 cooperates between the retainer member 19 and an annular rim 25. The annular rim 25 is formed on the center post 17 to bias the center post 17 in a direction away from retaining member 19. A battery 27 is electrically and physically connected to the LED circuit board 15 by a second spring 29 and contact member 31. In engagement within the cigarette lighter receptacle 02, the center post 17 is compressed during insertion of the flashlight body 01 into the cigarette lighter receptacle 02 so that the end of center post 17 moves second spring 29 and contact member 31 away from LED circuit board 15. This will allow charging of the battery 27 from the cigarette lighter receptacle's power source (car battery) while at the same time disconnecting the LED's 13 on LED circuit board 15 from the rechargeable battery 27. When the body 01 is disengaged from the cigarette lighter receptacle 02 the center post 17 returns to its original position. The original position of the center post 17 no longer recharges the battery 27, whereby the second spring member 29 and contacting member 31 couple with the LED circuit board 15 allowing the rechargeable battery 27 to connect with LED circuit board 15. The connection between the rechargeable battery 27 and the LED circuit board 15 automatically illuminates the LED's 13. Stated otherwise when the flashlight body 01 is removed from the cigarette lighter receptacle 02, post 17 disengages from contact member 31 and second spring 29 thus enabling contact member 31 and spring 29 to electrically connect battery 27 to LED circuit board 15 and the LED's 13 connected thereon. The light emitted by LED's 13 are directed through retainer member 19 and emanates through an opening in the first end 03 of flashlight body 01. It is preferred, that upon body 01 disengagement from the cigarette lighter receptacle 02 the LED's 13 automatically and instantaneously illuminate. As shown in FIG. 2, the battery 27 is supported by a circuit board 33 on the second end 05, which carries the necessary recharging circuitry as well as an output electrical connection. This output connection is only energized when the rechargeable flashlight 100 is charging within the cigarette lighter receptacle 02.

Figure 4:
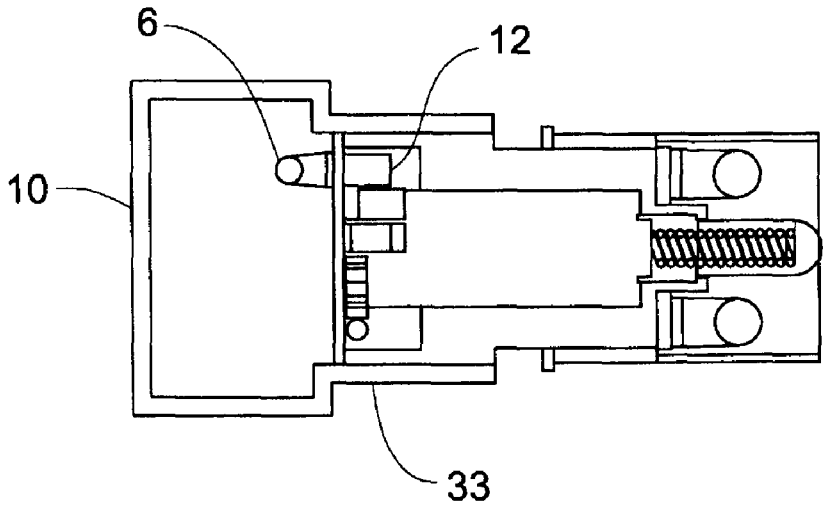
FIG. 4 is a cross sectional view of the preferred embodiment of the rechargeable flashlight with additional element.

In FIG. 4, an additional element is attached to rechargeable flashlight 100. The second end 05 of the cylindrical body 01 is constructed with a housing member 09. The housing member 09 is equipped to house a backlight assembly 08. As discussed above the backlight assembly 08 includes a second series of LED's 06 and lens 10. When the second series of LED's 06 are illuminated they reflect off lens 10 to provide an auxiliary light source in a vehicle. The backlight assembly 08 draws current directly from the vehicle's battery 47 (not shown), so as not to drain the rechargeable battery 27 that is charging. The backlight assembly 08 and housing member 09 are congruent with each other. The housing member 09 contains an opening 12 whereby the second series of LED's 06 may be slidably inserted into the opening 12. Because the second series of LED's 06 and lens 10 work in cooperation with each to form the backlight assembly 08, the backlight assembly 08 cooperates with the second end 05 for a tight fitting. The opening 12 is connected to the battery circuit board 33, this when the second series of LED's 06 is inserted into the opening it may draw current. It is contemplated that housing member may contain multiple opening to hold multiple supplemental light sources in the backlight assembly.

Figure 5:
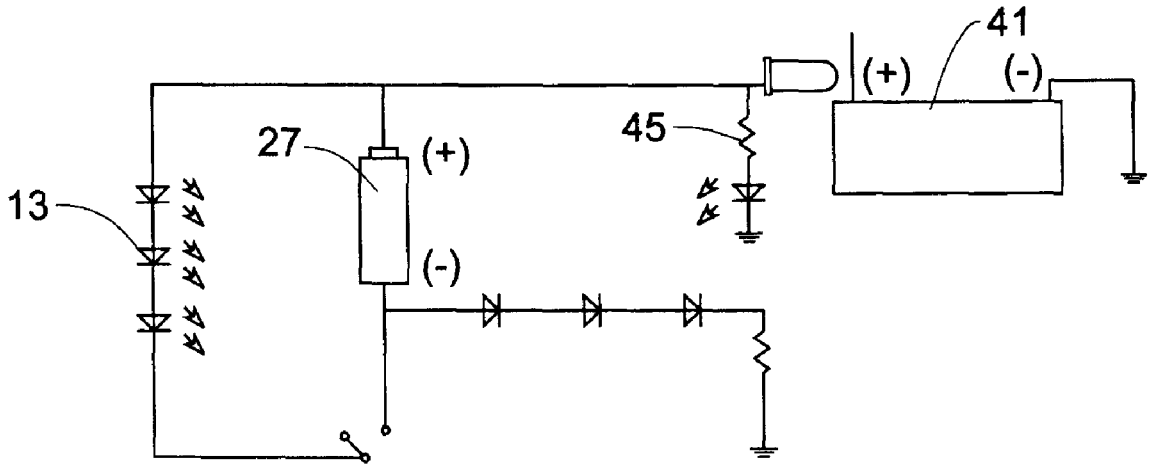
FIG. 5 is an electrical schematic of a rechargeable flashlight having an outer sleeve switch.

FIG. 5 is a schematic electrical diagram of the rechargeable flashlight. It includes a conventional vehicle battery 41 with the negative post connected to the vehicle ground polarity and the positive post connected to charging circuit or positive polarity of the vehicle battery system. In the charging position electricity from the vehicle battery 41 flows through the end plug and outer sleeve of the housing which is electrically coupled to the power supply have a rechargeable battery 27. As noted above, in the charging position the LED circuit board 15 is electrically disconnected from the rechargeable battery 27 hence the LED's 13 are not illuminated. In the charging position, two options are viable, the housing member 09 may accept the backlight assembly 08 or the housing member 09 may accept an auxiliary electrical device 47.

When accepting an auxiliary electrical device in the charging position, electricity flows through the first end to the second end of the housing, the second end of the housing having either a socket, USB, or back lighting. When accepting the backlight assembly in the charging position electricity from the vehicular battery 41 can also flow through the plug member 04, to a resistor 45, and finally to a second series of LEDs 06 located on the backlight assembly 08. The second series of LED's 06 will illuminate a lens 10 as described above.

Figure 6:
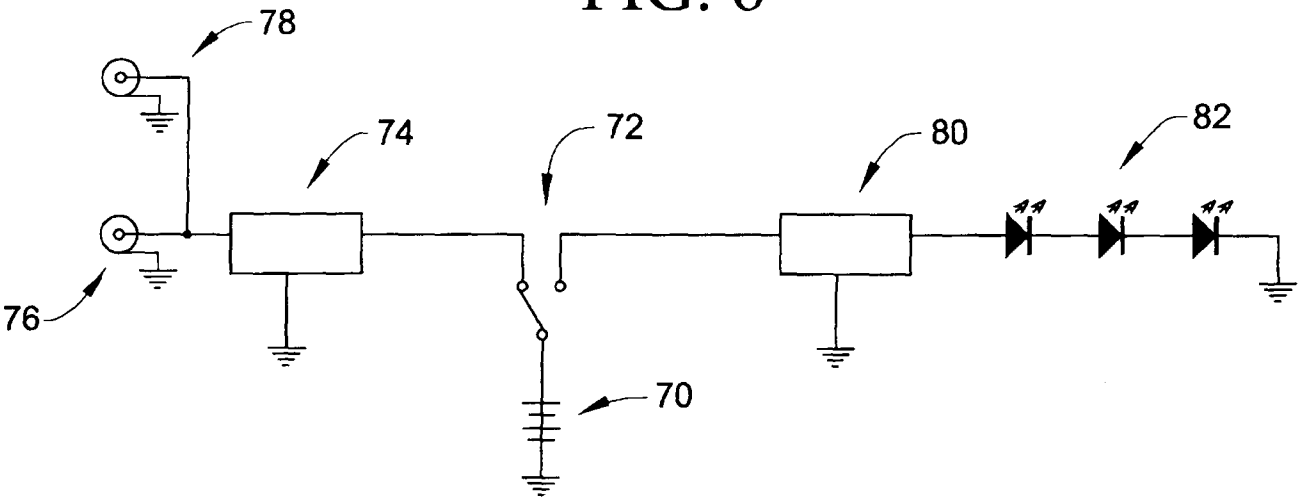
FIG. 6 is an electrical schematic of a rechargeable flashlight having a center, pin switch with LED's in a series configuration.

FIG. 6 is an electrical schematic of an embodiment of the rechargeable flashlight wherein a battery source 70 is operated by a center pin switch 72. When the center pin switch is disconnected, the battery charger circuit 74 is coupled to vehicle provided power source through power plug 76. In this embodiment the vehicle power source is directly coupled to the second end of the rechargeable flashlight which is in the form of a cigarette lighter receptacle 78. When the center pin switch is released, the battery 70 is disconnected from the battery charger 74 which provides power to a power regulation circuit 80 for operation of the series mounted LED's 82.

Figure 7:
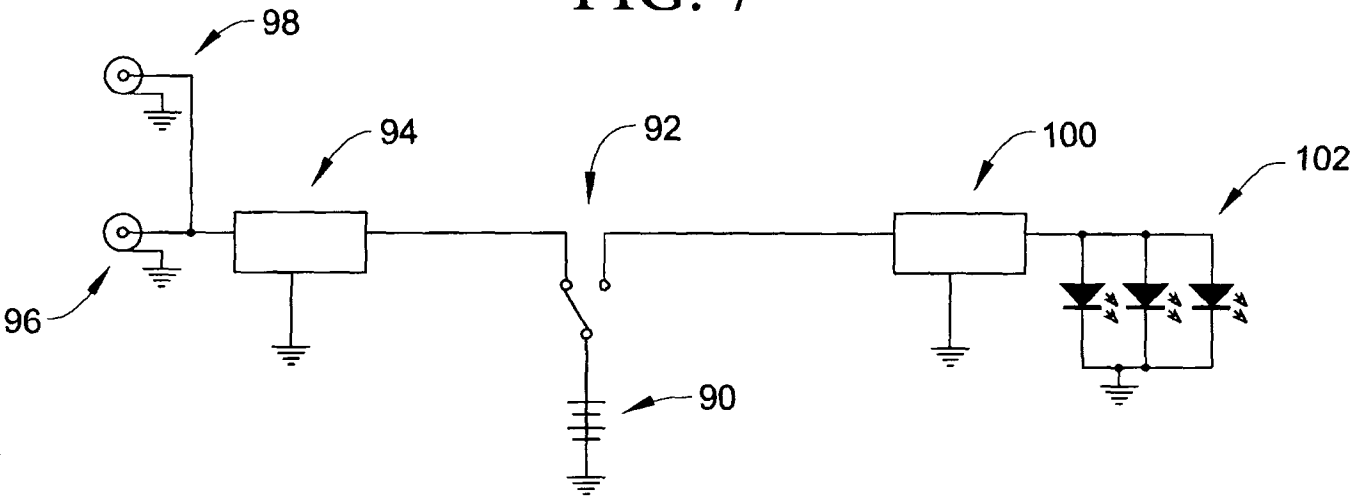
FIG. 7 is an electrical schematic of a rechargeable flashlight having a center pin switch with LED's in a parallel configuration.

FIG. 7 is an electrical schematic of an embodiment of the rechargeable flashlight using parallel positioned LED's, wherein a battery source 90 is operated by a center pin switch 92. When the center pin switch 92 is disconnected, the battery charger circuit 94 is coupled to vehicle provided power source through power plug 96. The vehicle power source is directly coupled to the second end of the rechargeable flashlight which is in the form of a cigarette lighter receptacle 98. When the center pin switch is released, the battery 90 is disconnected from the battery charger 94 which provides power to a power regulation circuit 100 for operation of the parallel mounted LED's 102.

Figure 8:
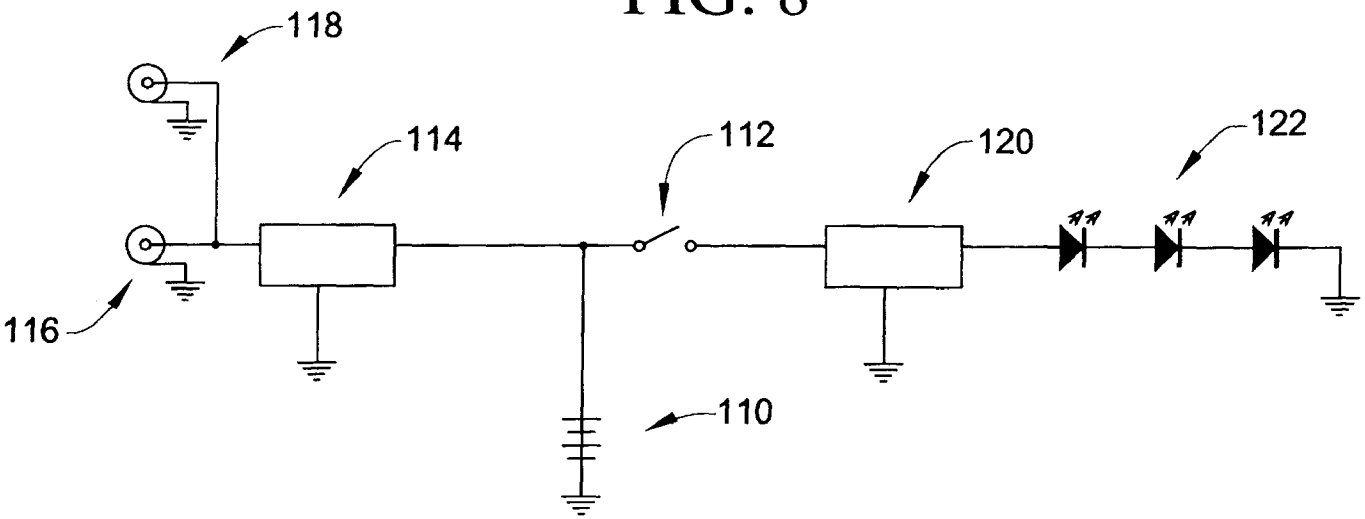
FIG. 8 is an electrical schematic of a rechargeable flashlight having a switch coupled to a battery with the LED's in a series configuration.

FIG. 8 is an electrical schematic of an embodiment of the rechargeable flashlight wherein a battery source 110 is operated by a slide switch 112. When the slide switch 112 is disconnected, the battery charger circuit 114 is coupled to vehicle provided power source through power plug 116. In this embodiment the vehicle power source is directly coupled to the second end of the rechargeable flashlight which is in the form of a cigarette lighter receptacle 118. When the switch 112 released, the battery 110 is disconnected from the battery charger 114 which provides power to a power regulation circuit 120 for operation of the series mounted LED's 122.

Figure 9:
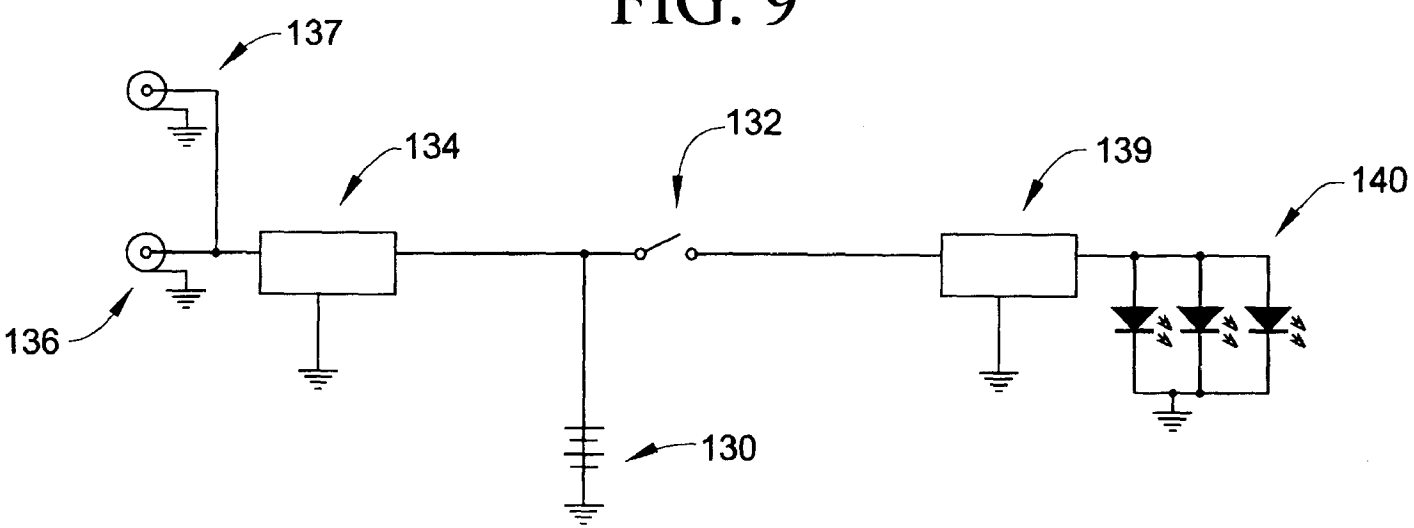
FIG. 9 is an electrical schematic of a rechargeable flashlight having a switch coupled with to a battery with the LED's in a parallel configuration.

FIG. 9 is an electrical schematic of an embodiment of the rechargeable flashlight having parallel placed LED's wherein a battery source 130 is operated by a slide switch 132. When the slide switch 132 is disconnected, the battery charger circuit 134 is coupled to vehicle provided power source through power plug 136. In this embodiment the vehicle power source is directly coupled to the second end of the rechargeable flashlight which is in the form of a cigarette lighter receptacle 137. When the switch 132 released, the battery 130 is disconnected from the battery charger 134 which provides power to a power regulation circuit 138 for operation of the parallel mounted LED's 139.

Figure 10:
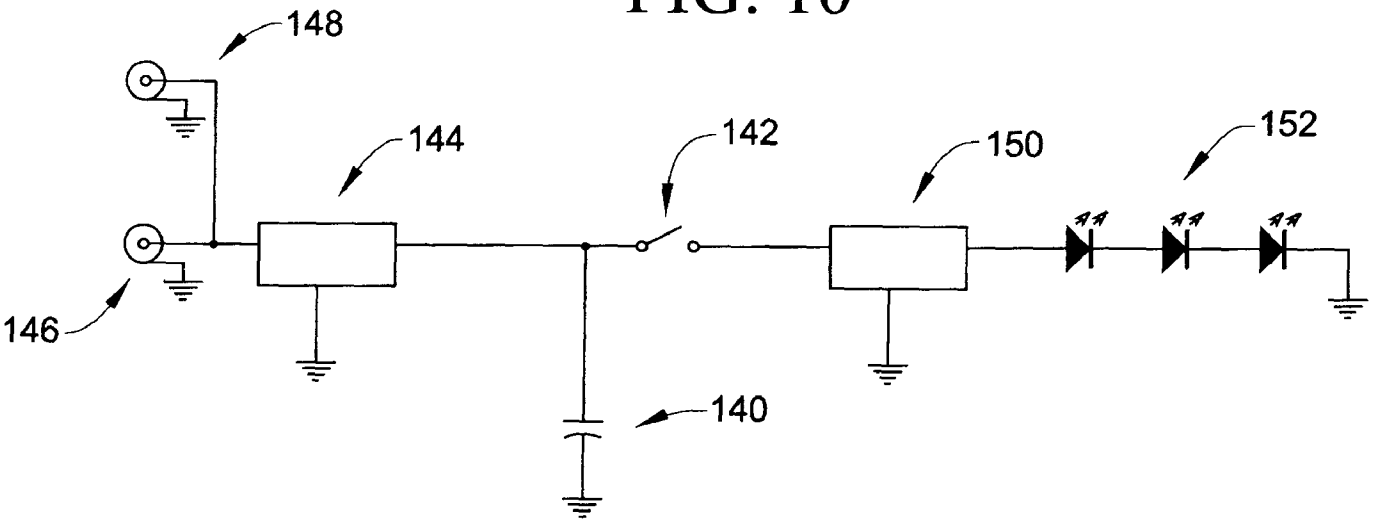
FIG. 10 is an electrical schematic of a rechargeable flashlight having a switch coupled to a capacitor with the LED's in a series configuration.

FIG. 10 is an electrical schematic of an embodiment of the rechargeable flashlight having a power source 140 being a chargeable capacitor, which is operated by a slide switch 142. When the slide switch 142 is disconnected, the charger circuit 144 is coupled to vehicle provided power source through power plug 146. In this embodiment the vehicle power source is directly coupled to the second end of the rechargeable flashlight which is in the form of a cigarette lighter receptacle 148. When the switch 142 released, the capacitor 140 is disconnected from the charger circuit 144 which provides power to a power regulation circuit 150 for operation of the series mounted LED's 152.

Figure 11:
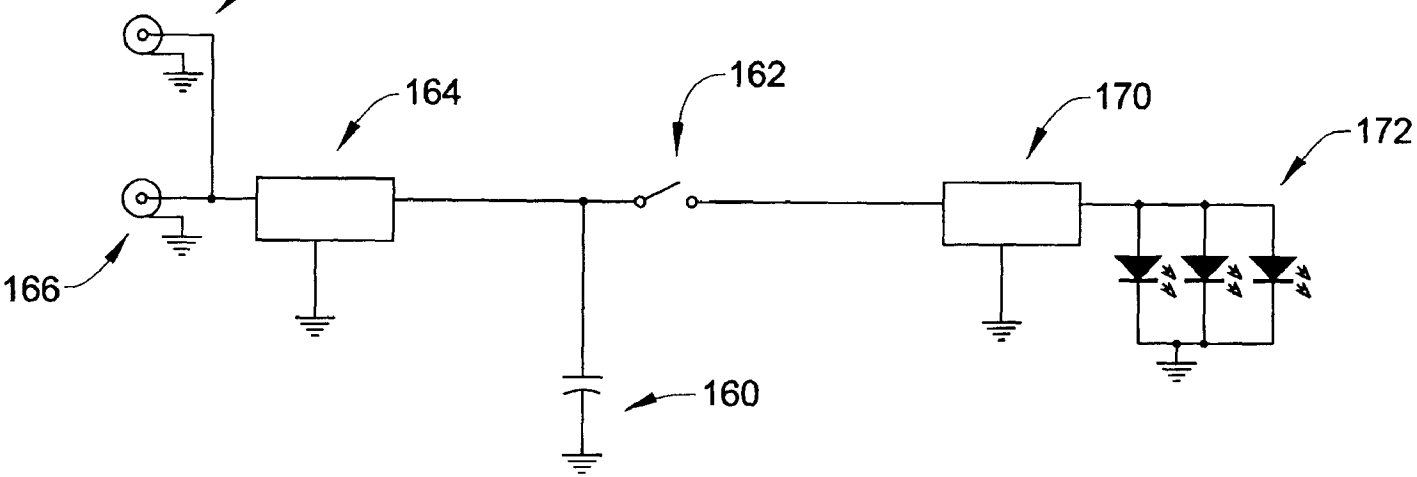
FIG. 11 is an electrical schematic of a rechargeable flashlight having a switch coupled to a capacitor with the LED's in a parallel configuration.

FIG. 11 is an electrical schematic of an embodiment of the rechargeable flashlight using parallel positioned LED having a power source 160 being a chargeable capacitor, which is operated by a slide switch 162. When the slide switch 162 is disconnected, the charger circuit 164 is coupled to vehicle provided power source through power plug 166. In this embodiment the vehicle power source is directly coupled to the second end of the rechargeable flashlight which is in the form of a cigarette lighter receptacle 168. When the switch 162 released, the capacitor 160 is disconnected from the charger circuit 164 which provides power to a power regulation circuit 170 for operation of the series mounted LED's 172.

Figure 12:
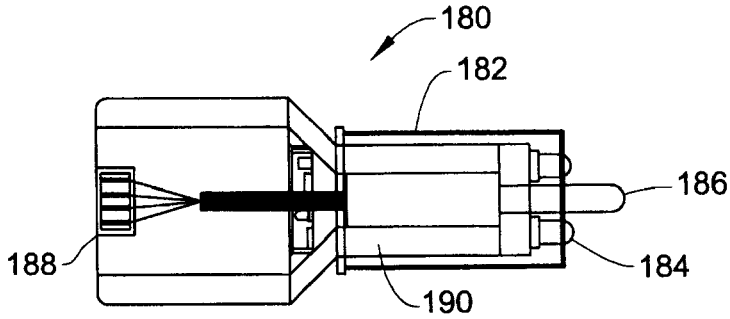
FIG. 12 is a cross sectional side view of a rechargeable flashlight having a sleeve switch with a USB port.

Now referring to FIG. 12, depicted is a rechargeable flashlight 180 having a sleeve switch 182 which provides an automatic power supply connection when the flashlight is removed from a receptacle. The sleeve switch operates as an on/off actuator by use of frictional engagement with a vehicle mounted receptacle. The illumination device can be either LED or neon 184 with power provided from the vehicle receptacle through the terminal contact plug 186 and sleeve 182. The rechargeable flashlight in this embodiment employs a USB port 188 which, in accordance with the previously described electrical schematic, receives power directly from the vehicle power source through the end plug 186 and sleeve 182 when the LED's are not operating. Batteries 190, or capacitors, are mounted within the housing to provide voltage to the LED's when the flashlight is disconnected from the receptacle, and thus the power supply.

Figure 13:
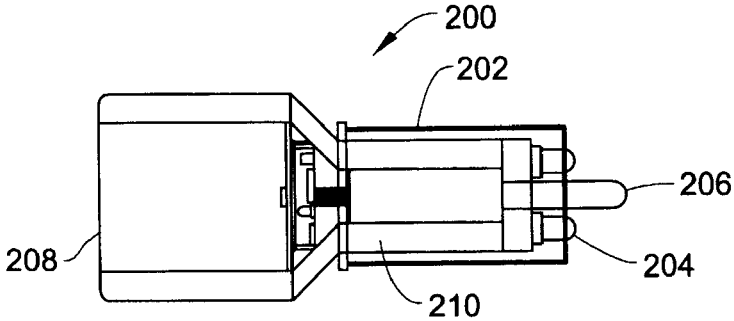
FIG. 13 is a cross sectional side view of the rechargeable flashlight having a sleeve with a socket receptacle.

Now referring to FIG. 13, depicted is a rechargeable flashlight 200 having a sleeve switch 202 which provides an automatic power supply connection when the flashlight is removed from a receptacle. The illumination device can be either LED or neon 204 with power provided from the vehicle receptacle through the terminal contact plug 206 and sleeve 202. The rechargeable flashlight in this embodiment employs a socket port 208 which, in accordance with the previously described electrical schematic, receives power directly from the vehicle power source through the end plug 206 and sleeve 202 when the LED's are not operating. Batteries 210, or capacitors, are mounted within the housing to provide voltage to the LED's when the flashlight is disconnected from the receptacle, and thus the power supply.

Figure 14:
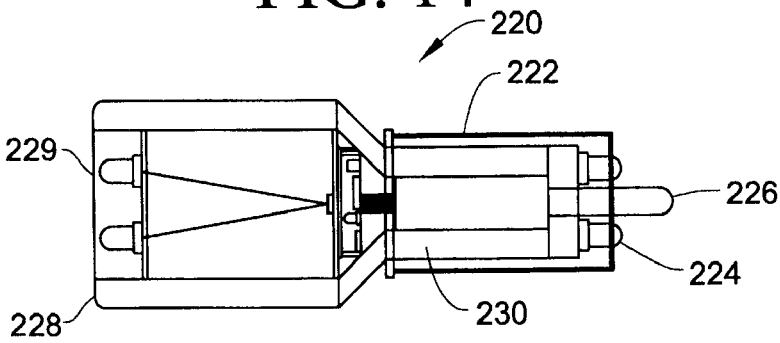
FIG. 14 is a cross sectional side view of the rechargeable flashlight having a sleeve on/off switch with an illuminated second end.

Now referring to FIG. 14, depicted is a rechargeable flashlight 220 having a sleeve switch 222 which provides an automatic power supply connection when the flashlight is removed from a receptacle. The illumination device can be either LED or neon 224 with power provided from the vehicle receptacle through the terminal contact plug 226 and sleeve 222. The rechargeable flashlight in this embodiment employs an illuminated second end using LED's 228 with a lens placed over the LED's for illumination of a logo or other indicia. The LED's receive power directly from the vehicle power source through the end plug 226 and sleeve 222 when the first end LED's 222 are not operating. Batteries 230, or capacitors, are mounted within the housing to provide voltage to the LED's when the flashlight is disconnected from the receptacle, and thus the power supply.

Figure 15:
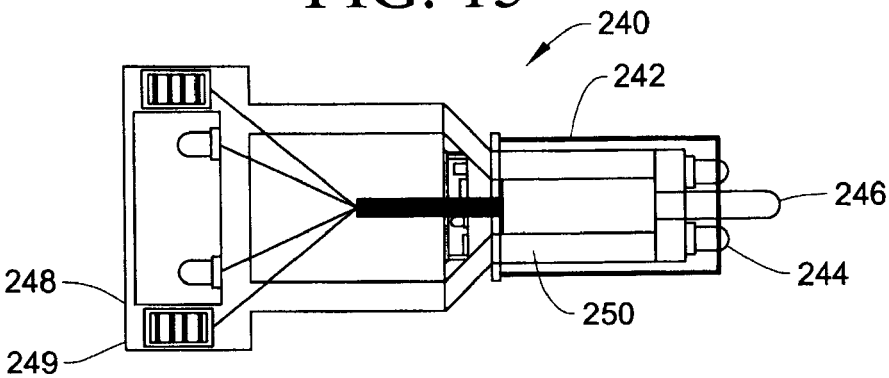
FIG. 15 is a cross sectional side view of the rechargeable battery having a sleeve with an on/off switch with an illuminated second end and multiple USB ports.

Now referring to FIG. 15, depicted is a rechargeable flashlight 240 having a sleeve switch 242 which provides an automatic power supply connection when the flashlight is removed from a receptacle. The illumination device can be either LED or neon 244 with power provided from the vehicle receptacle through the terminal contact plug 246 and sleeve 242. The rechargeable flashlight in this embodiment employs an illuminated second end using LED's 248 in conjunction with at least one USB port 249. The LED's and USB's receive power directly from the vehicle power source through the end plug 246 and sleeve 242 when the first end LED's 244 are not operating. Batteries 250, or capacitors, are mounted within the housing to provide voltage to the LED's when the flashlight is disconnected from the receptacle, and thus the power supply.

Figure 16:
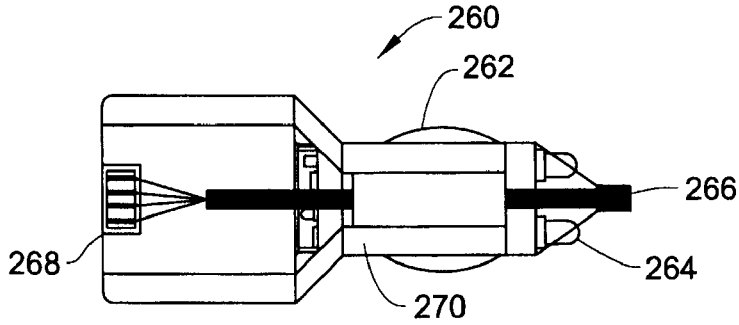
FIG. 16 is a cross sectional side view of a rechargeable flashlight with an end plug on/off switch with a USB port.

Now referring to FIG. 16, depicted is a rechargeable flashlight 260 having a strap ground 262 which provides the polarity grounding for coupling to a power supply. The illumination device can be either LED or neon 184 with power provided from the vehicle receptacle through the terminal contact plug 186 which further operates as the on/off switch. The rechargeable flashlight in this embodiment employs a USB port 268 which, in accordance with the previously described electrical schematic, receives power directly from the vehicle power source through the end plug 266 and strap 262 when the LED's are not operating. Batteries 270, or capacitors, are mounted within the housing to provide voltage to the LED's when the flashlight is disconnected from the receptacle, and thus the power supply.

Figure 17:
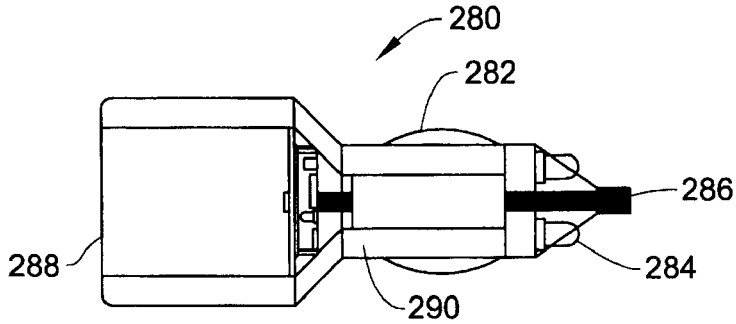
FIG. 17 is a cross sectional side view of the rechargeable flashlight having and ad end plug member on/off switch with a socket receptacle.

Now referring to FIG. 17, depicted is a rechargeable flashlight 280 having a strap ground 282 which provides the polarity grounding for coupling to a power supply. The illumination device can be either LED or neon 284 with power provided from the vehicle receptacle through the terminal contact plug 286 which further operates as the on/off switch. The rechargeable flashlight in this embodiment employs a socket port 288 which, in accordance with the previously described electrical schematic, receives power directly from the vehicle power source through the end plug 286 and strap 282 when the LED's are not operating. Batteries 290, or capacitors, are mounted within the housing to provide voltage to the LED's when the flashlight is disconnected from the receptacle, and thus the power supply.

Figure 18:
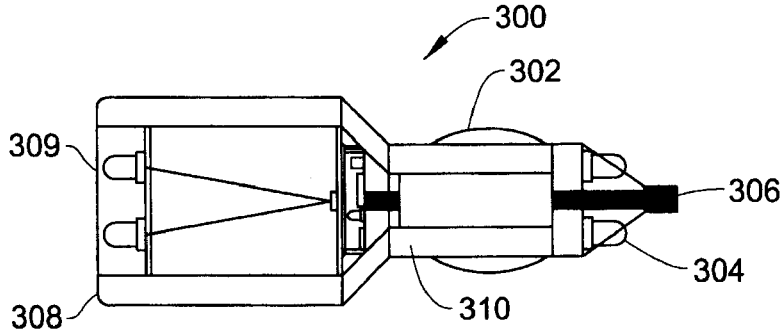
FIG. 18 is a cross sectional side view of a rechargeable flashlight having a plug member on/off switch and an illuminated second end.

Now referring to FIG. 18, depicted is a rechargeable flashlight 300 having a strap ground 302 which provides the polarity grounding for coupling to a power supply. The illumination device can be either LED or neon 304 with power provided from the vehicle receptacle through the terminal contact plug 306 which further operates as the on/off switch. The rechargeable flashlight in this embodiment employs an illuminated second end using LED's 308 with a lens 309 placed over the LED's for illumination of a logo or other indicia. The LED's receive power directly from the vehicle power source through the end plug 306 and strap 302 when the first end LED's 306 are not operating. Batteries 310, or capacitors, are mounted within the housing to provide voltage to the LED's when the flashlight is disconnected from the receptacle, and thus the power supply.

Figure 19:
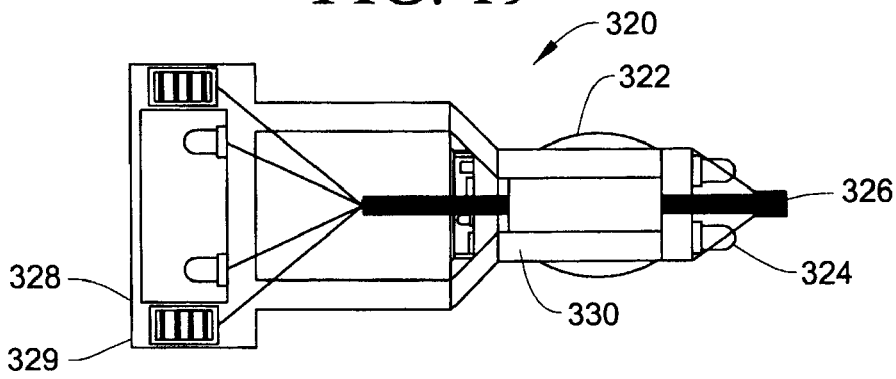
FIG. 19 is a rechargeable cross sectional view of a rechargeable flashlight with a plug member having an on/off switch and an illuminated second end with USB ports.

Now referring to FIG. 19, depicted is a rechargeable flashlight 320 having a strap ground 332 which provides the polarity grounding for coupling to a power supply. The illumination device can be either LED or neon 324 with power provided from the vehicle receptacle through the terminal contact plug 326 which further operates as the on/off switch. The LED's 328 and USB's 329 receive power directly from the vehicle power source through the end plug 326 and strip 332 when the first end LED's 324 are not operating. Batteries 330, or capacitors, are mounted within the housing to provide voltage to the LED's when the flashlight is disconnected from the receptacle, and thus the power supply.

Figure 20:
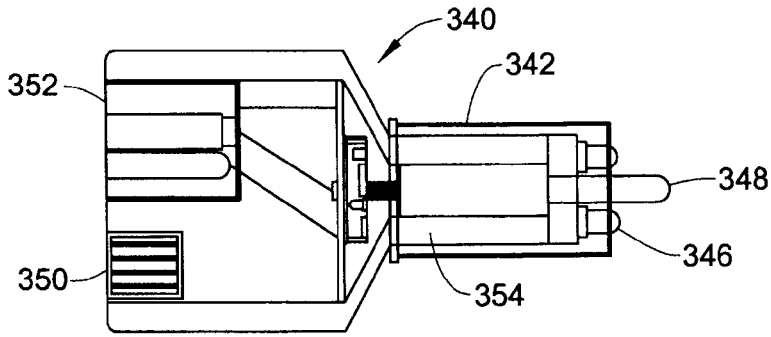
FIG. 20 is a cross sectional side view of a rechargeable battery having a sleeve with an on/off switch and a USB port with a 120 volt socket receptacle.

Now referring to FIG. 20, depicted is a rechargeable flashlight 340 having a sleeve switch 342 which provides an automatic power supply connection when the flashlight is removed from a receptacle. The sleeve switch operates as an on/off actuator by use of frictional engagement with a vehicle mounted receptacle. The illumination device can be either LED or neon 346 with power provided from the vehicle receptacle through the terminal contact plug 348 and sleeve 342. The rechargeable flashlight in this embodiment employs a USB port 350 which, in accordance with the previously described electrical schematic, receives power directly from the vehicle power source through the end plug 348 and sleeve 342 when the LED's are not operating. A 120V socket 352 is further provided in this embodiment with a circuitry provided for converting from low voltage DC to AC. Batteries 354, or capacitors, are mounted within the housing to provide voltage to the LED's when the flashlight is disconnected from the receptacle, and thus the power supply.

Figure 21:
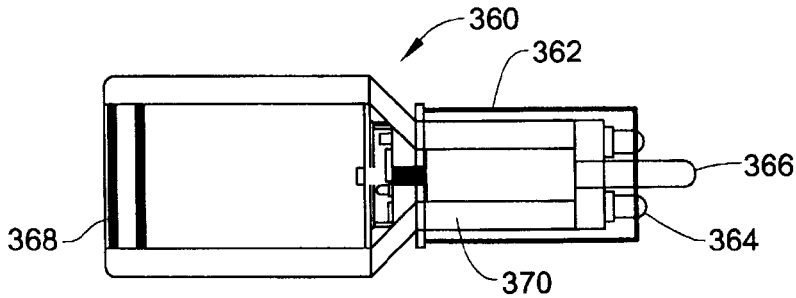
FIG. 21 is a cross sectional side view of a rechargeable battery having a sleeve with an on/off switch and a socket receptacle illuminated with a neon light.

Now referring to FIG. 21, depicted is a rechargeable flashlight 360 having a sleeve switch 362 which provides an automatic power supply connection when the flashlight is removed from a receptacle. The illumination device can be either LED or neon 364 with power provided from the vehicle receptacle through the terminal contact plug 366 and sleeve 362. The rechargeable flashlight in this embodiment employs a socket port 368 which, in accordance with the previously described electrical schematic, receives power directly from the vehicle power source through the end plug and sleeve when the LED's are not operating. The socket 368 is lined with a neon light which illuminates the rim for ease of inserting accessories in low level lighting conditions. Batteries 392, or capacitors, are mounted within the housing to provide voltage to the LED's when the flashlight is disconnected from the receptacle, and thus the power supply.

Figure 22:
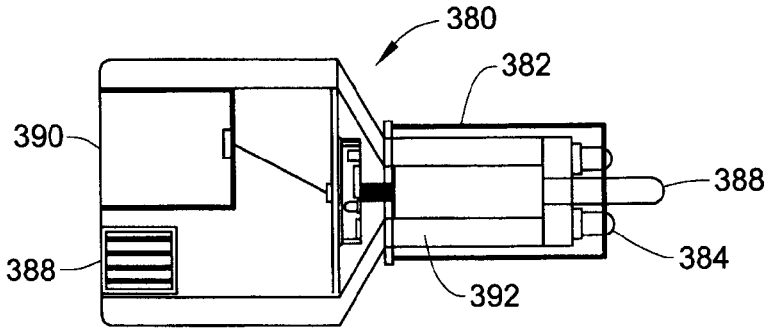
FIG. 22 is a cross sectional side view of a rechargeable flashlight having a sleeve with an on/off switch and a socket receptacle and USB port combination.

Now referring to FIG. 22 depicted is a rechargeable flashlight 380 having a sleeve switch 382 which provides an automatic power supply connection when the flashlight is removed from a receptacle. The illumination device can be either LED or neon 384 with power provided from the vehicle receptacle through the terminal contact plug 386 and sleeve 382. The rechargeable flashlight in this embodiment employs a second end housing a USB port 388 and a receptacle socket 390. Batteries 392, or capacitors, are mounted within the housing to provide voltage to the LED's when the flashlight is disconnected from the receptacle, and thus the power supply.

Figure 23:
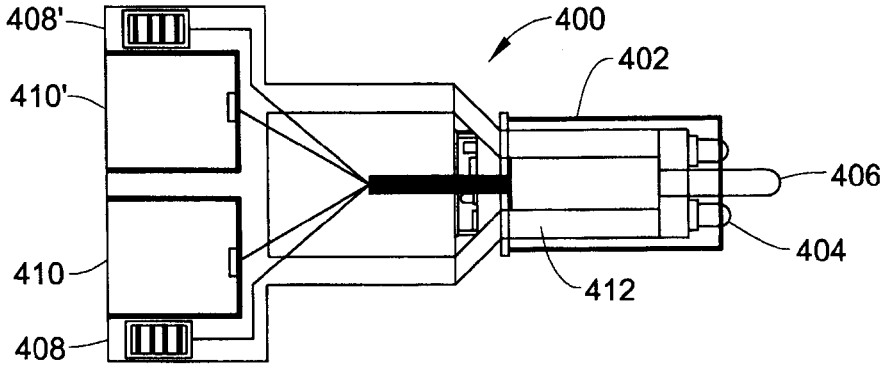
FIG. 23 is a cross sectional side view of a rechargeable flashlight having a sleeve with an on/off switch and two 12 volt sockets with two USB ports as receptacles.

Now referring to FIG. 23, depicted is a rechargeable flashlight 400 having a sleeve switch 482 which provides an automatic power supply connection when the flashlight is removed from a receptacle. The illumination device can be either LED or neon 404 with power provided from the vehicle receptacle through the terminal contact plug 406 and sleeve 402. The rechargeable flashlight in this embodiment employs first and second USB 408 & 408' and a first and second receptacle socket 410 & 410'. The sockets and USB's receive power directly from the vehicle power source through the end plug 406 and sleeve 402 when the first end LED's 404 are not operating. Batteries 412, or capacitors, are mounted within the housing to provide voltage to the LED's when the flashlight is disconnected from the receptacle, and thus the power supply.

Figure 24:
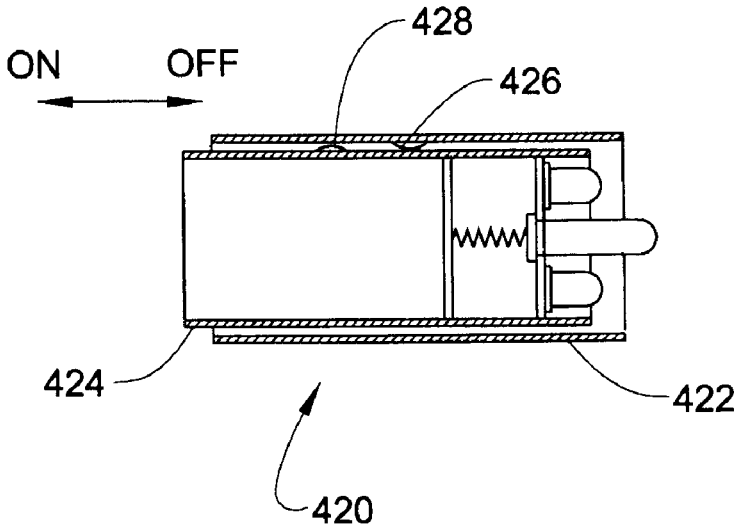
FIG. 24 is a cross sectional side view of a sleeve switch.
Figure 25:
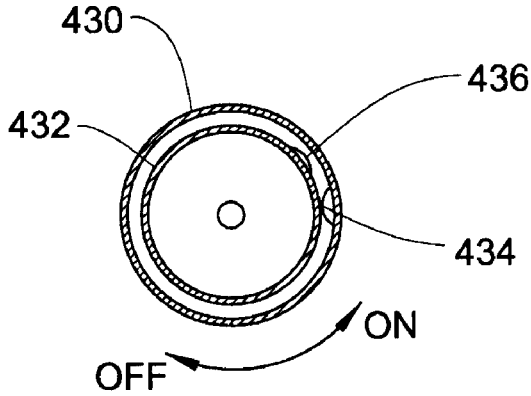
FIG. 25 is an end view with the hosing having a twist on/off switch.

Now referring to FIG. 24, shown is the push pull housing 420 having an outer sleeve 422 and an inner sleeve 424. A first contact 426 is affixed to the outer housing 422 and a second contact 428 is affixed to the inner housing 424. In operation, the outer housing 422 engages the cigarette lighter receptacle on a conventional vehicle and the frictional engagement causes the slideable engagement of the outer housing to align with the contact of the inner housing to cause coupling of the battery power supply to the LED's. An alternative switch mechanism is shown in FIG. 25 wherein the outer housing 430 is juxtaposition to the inner housing 432 with a first contact 434 and a second contact 436 engageable by twisting of the housing so as to align the contacts for purposes of completing the circuit between the battery and illumination device.

Figure 26:
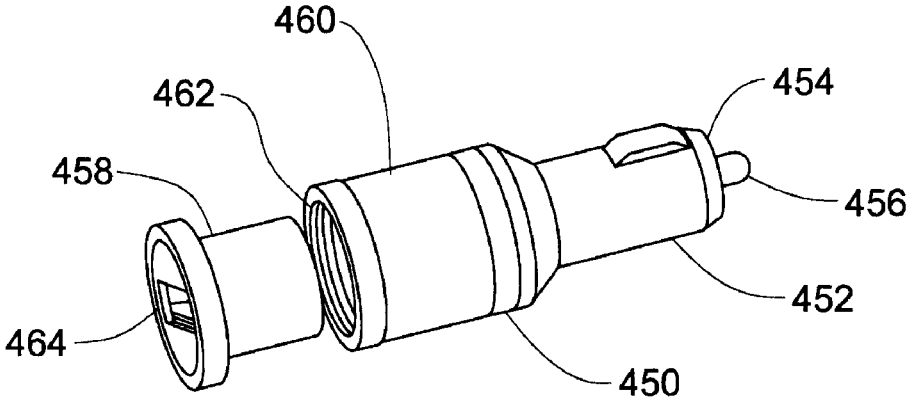
FIG. 26 is a perspective view of a rechargeable flashlight with a removable USB port.

Now referring to FIG. 26, depicted is a rechargeable flashlight 450 having a combination ground and on/off slide switch 452 which provides the polarity grounding for coupling to a power supply. The illumination device is LED 454 with power provided from the vehicle receptacle through the terminal contact plug 456 for positive polarity and a ground from the slide switch 452. The rechargeable flashlight in this embodiment employs a removably insertable BSE port 458 which, in accordance with the previously described electrical schematic, receives power directly from the vehicle power source through the end plug 456 and strap 452 when the LED's are not operating. Batteries or capacitors are mounted within the housing 460 to provide voltage to the LED's when the flashlight is disconnected from the receptacle, and thus the power supply. The housing 460 includes a power socket 462 for receipt of external power plugs with the USB port 458 sized for slidable insertion to convert the open socket 462 into a USB port 464.

The housing 460 is deeper than a conventional plug insert. The deeper plug insert allows for a deeper insertion of a flashlight of the instant invention, permitting a near flush mounting of the device. Such an application is particularly suited for OEM use wherein the vehicle is designed to accommodate a more aesthetically pleasing flashlight with minimal protrusion, or allowing for flashlights have a greater power reserve.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

The invention claimed is:

1. A rechargeable flashlight comprising of:

a housing defined by a generally cylindrical shape having a first end and a second end, said first end constructed and arranged for insertion into a cigarette lighter receptacle; said first end having an outer surface for making electrical contact to a first polarity input of a power source and a plug member positioned along an inner surface for making electrical contact to a second polarity input of the power source;

a power supply positioned within said housing and electrically coupled to said first and second polarity inputs;

at least one illuminating device positioned along said first end; and a switch means for coupling said battery to said illuminating device;

wherein said first end of said housing is inserted into the cigarette lighter receptacle providing storage and battery charging.

2. The rechargeable flashlight according to claim 1, wherein said switch means is further defined as an engagement of said power supply and said illuminating device upon removal of said plug member from said cigarette lighter receptacle.

3. The rechargeable flashlight according to claim 1, wherein said illuminating device illuminates instantaneously upon said engagement with said power supply.

4. The rechargeable flashlight according to claim 1, wherein said power supply is a rechargeable battery.

5. The rechargeable flashlight according to claim 1, wherein said illuminating device is at least one LED.

6. The rechargeable flashlight according to claim 1, wherein said illuminating device is a neon light.

7. The rechargeable flashlight according to claim 1, wherein said illuminating device is an incandescent bulb.

8. The rechargeable flashlight according to claim 1, wherein said switch means is a sleeve positioned around said first end, said sleeve frictionally engaging an inner side wall of said cigarette lighter receptacle causing movement from an off position while positioned within said receptacle to an on position when removed from said receptacle.

9. The rechargeable flashlight according to claim 1, wherein said switch means is a ground strap positioned along said first end, said ground strap frictionally engaging an inner side wall of said cigarette lighter receptacle causing movement from an off position while positioned within said receptacle to an on position when removed from said receptacle.

10. The rechargeable flashlight according to claim 1, wherein said switch means is a plug member electrically engaging an end wall of said cigarette lighter receptacle causing movement from an off position while positioned within said receptacle to an on position when removed from said receptacle.

11. The rechargeable flashlight according to claim 1, wherein said switch means is a slide switch located along an outer side surface of said housing, said slide switch movable from an off position while positioned within said receptacle to an on position when removed from said receptacle.

12. The rechargeable flashlight according to claim 1, wherein said second end of said housing forms at least one cigarette lighter receptacle electrical coupled with said first end and constructed and arranged to receive power from said power source through said first and second polarity input.

13. The rechargeable flashlight according to claim 1, wherein said second end of said housing includes a USB receptacle electrical coupled with said first end and constructed and arranged to receive power from said power source through said first and second polarity input.

14. The rechargeable flashlight according to claim 1, wherein said second end of said housing includes an illumination means.

15. The rechargeable flashlight according to claim 14, wherein said second end of said housing includes a translucent lens having indicia thereon.

16. The rechargeable flashlight according to claim 1, wherein said power supply is a rechargeable capacitor.

17. The rechargeable flashlight according to claim 1 including a removably insertable USB receptacle, said USB receptacle constructed and arranged to receive power from said power source through said first and second polarity input.

18. A rechargeable flashlight comprising of:

a housing defined by a generally cylindrical shape having a first end and a second end, said first end constructed and arranged for insertion into a cigarette lighter receptacle; said first end having an outer surface for making electrical contact to a first polarity input of a power source and a plug member positioned along an inner surface for making electrical contact to a second polarity input of the power source;

a power supply having a rechargeable battery positioned within said housing and electrically coupled to said first and second polarity inputs;

at least one LED illuminating device positioned along said first end; and a automatic switch means for coupling said battery to said LED illuminating device upon removal of said housing from said cigarette lighter receptacle;

wherein said first end of said housing is inserted into the cigarette lighter receptacle providing storage and battery charging.

19. The rechargeable flashlight according to claim 18, wherein said switch means is a sleeve positioned around said first end, said sleeve frictionally engaging an inner side wall of said cigarette lighter receptacle causing movement from an off position while positioned within said receptacle to an on position when removed from said receptacle.

20. The rechargeable flashlight according to claim 18, wherein said switch means is a ground strap positioned along said first end, said ground strap frictionally engaging an inner side wall of said cigarette lighter receptacle causing movement from an off position while positioned within said receptacle to an on position when removed from said receptacle.

21. The rechargeable flashlight according to claim 18, wherein said switch means is a plug member electrically engaging an end wall of said cigarette lighter receptacle causing movement from an off position while positioned within said receptacle to an on position when removed from said receptacle.

22. The rechargeable flashlight according to claim 18, wherein said switch means is a slide switch located along an outer side surface of said housing, said slide switch movable from an off position while positioned within said receptacle to an on position when removed from said receptacle.

23. The rechargeable flashlight according to claim 18, wherein said second end of said housing forms at least one cigarette lighter receptacle electrical coupled with said first end and constructed and arranged to receive power from said power source through said first and second polarity input.

24. The rechargeable flashlight according to claim 18, wherein said second end of said housing includes a USB receptacle electrical coupled with said first end and constructed and arranged to receive power from said power source through said first and second polarity input.

25. The rechargeable flashlight according to claim 18 including a removably insertable USB receptacle, said USB receptacle constructed and arranged to receive power from said power source through said first and second polarity input.

26. The rechargeable flashlight according to claim 18, wherein said second end of said housing includes an illumination means.

27. The rechargeable flashlight according to claim 26, wherein said second end of said housing includes a translucent lens having indicia thereon.

28. The rechargeable flashlight according to claim 18, wherein said LED illuminating device produces a white light.

29. The rechargeable flashlight according to claim 18, wherein said LED illuminating device produces a colored light.

30. The rechargeable flashlight according to claim 18, wherein said LED illuminating device produces a colored light.

31. A rechargeable flashlight comprising of:

a housing having a first end and a second end, said first end constructed and arranged for insertion into a cigarette lighter receptacle; said first end having an outer surface for making electrical contact to a first polarity input of a power source and a plug member positioned along an inner surface for making electrical contact to a second polarity input of the power source;

a rechargeable power supply having positioned within said housing and electrically coupled to said first and second polarity inputs;

at least one LED illuminating device positioned along said first end; and a slide switch for coupling said power supply to said LED illuminating device upon removal of said housing from said cigarette lighter receptacle;

wherein said first end of said housing is inserted into the cigarette lighter receptacle providing storage and power supply charging.

32. The rechargeable flashlight according to claim 31, wherein said slide switch is located along an outer side surface of said housing, said slide switch movable to couple said power supply to said LED illuminating device.

33. The rechargeable flashlight according to claim 31, wherein said slide switch is located along an outer side surface of said housing, said slide switch movable from an off position while positioned within said receptacle to an on position when removed from said receptacle.

34. The rechargeable flashlight according to claim 31 wherein said second end of said housing forms at least one cigarette lighter receptacle electrical coupled with said first end and constructed and arranged to receive power from said power source through said first and second polarity input.

35. The rechargeable flashlight according to claim 31 wherein said second end of said housing includes a USB receptacle electrical coupled with said first end and constructed and arranged to receive power from said power source through said first and second polarity input.

36. The rechargeable flashlight according to claim 31 wherein said second end of said housing includes an illumination means.

37. The rechargeable flashlight according to claim 36 wherein said second end of said housing includes a translucent lens having indicia thereon.

38. The rechargeable flashlight according to claim 31 wherein said LED illuminating device produces a white light.

39. The rechargeable flashlight according to claim 31, wherein said LED illuminating device produces a colored light.

40. The rechargeable flashlight according to claim 31, wherein said LED colored light is red wherein said red is usable for aviation.

41. The rechargeable flashlight according to claim 31 wherein said power supply is a rechargeable battery.

42. The rechargeable flashlight according to claim 31, wherein said power supply is a rechargeable capacitor.

43. The rechargeable flashlight according to claim 31 including a removably insertable USB receptacle, said USB receptacle constructed and arranged to receive power from said power source through said first and second polarity input.

* * * * *